United States Patent [19]

Ehle et al.

[11] Patent Number: 4,682,341

[45] Date of Patent: Jul. 21, 1987

[54] ELECTRIC ARC FURNACE

[75] Inventors: Joachim Ehle, Lautenbach; Klaus Timm, Wentorf; Heinfried Ahlers, Asendorf, all of Fed. Rep. of Germany

[73] Assignee: Fuchs Systemtechnik GmbH, Willstät-Legelshurst, Fed. Rep. of Germany

[21] Appl. No.: 802,252

[22] Filed: Nov. 27, 1985

[30] Foreign Application Priority Data

Nov. 29, 1984 [DE] Fed. Rep. of Germany ..... 3443574
May 10, 1985 [DE] Fed. Rep. of Germany ..... 3516940

[51] Int. Cl.[4] ..... H05B 7/10
[52] U.S. Cl. ..... 373/99; 373/103
[58] Field of Search ..... 373/101, 103, 98, 99

[56] References Cited

U.S. PATENT DOCUMENTS

| | | | |
|---|---|---|---|
| 2,494,775 | 1/1950 | Moore | 13/14 |
| 3,433,878 | 3/1969 | Sundberg et al. | 373/103 |
| 4,153,812 | 5/1979 | Persson | 373/103 |
| 4,323,717 | 4/1982 | Garner et al. | 373/101 |

FOREIGN PATENT DOCUMENTS

| | | |
|---|---|---|
| 629611 | 4/1936 | Fed. Rep. of Germany . |
| 1171161 | 5/1964 | Fed. Rep. of Germany . |
| 520319 | 4/1940 | United Kingdom . |

*Primary Examiner*—Roy N. Envall, Jr.

[57] ABSTRACT

In an electric arc furnace having a fluid-cooled electrode support arm which is provided with an electrode holding means, the outside of the electrode support arm is plated with cooper and the electrode holding means is electrically insulated with respect to the support arm, by way of which the electrode current is carried to a contact jaw that bears against the electrode. In an electric arc furnace with for example three parallel electrode support arms the electrode current is taken partly by way of a heavy-current tube and partly by way of the electrode support arm in order to balance the different reactance in relation to the two other electrode support arms. In order to eliminate reactance asymmetry, a reactance loop is provided in at least one heavy-current conductor between the transformer of the electric arc furnace and the associated electrode support arm.

17 Claims, 9 Drawing Figures

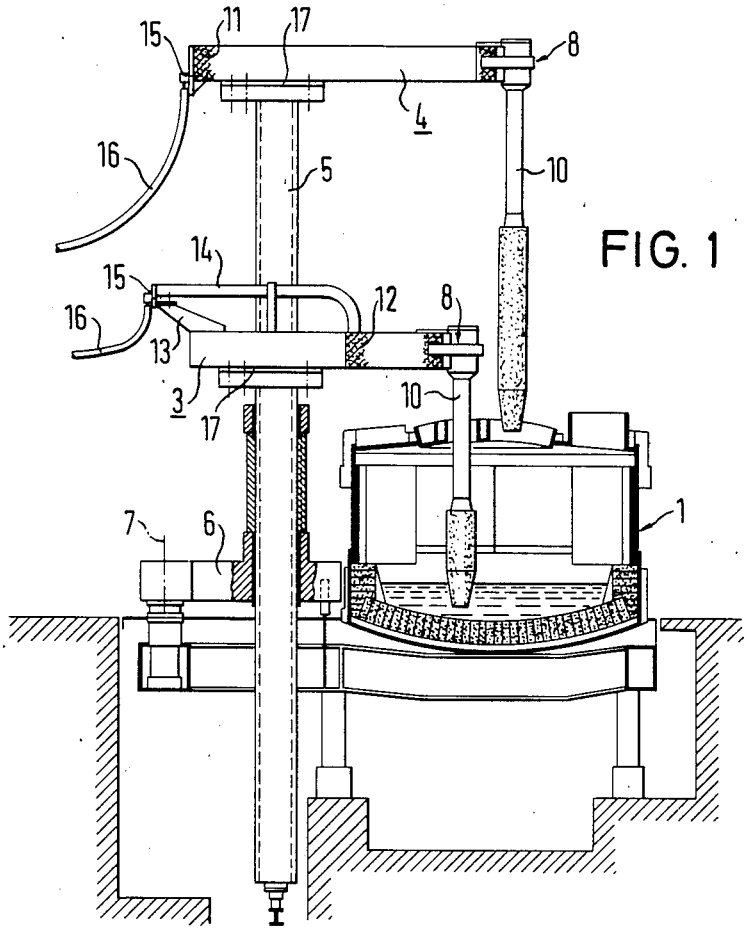
FIG. 1
FIG. 2
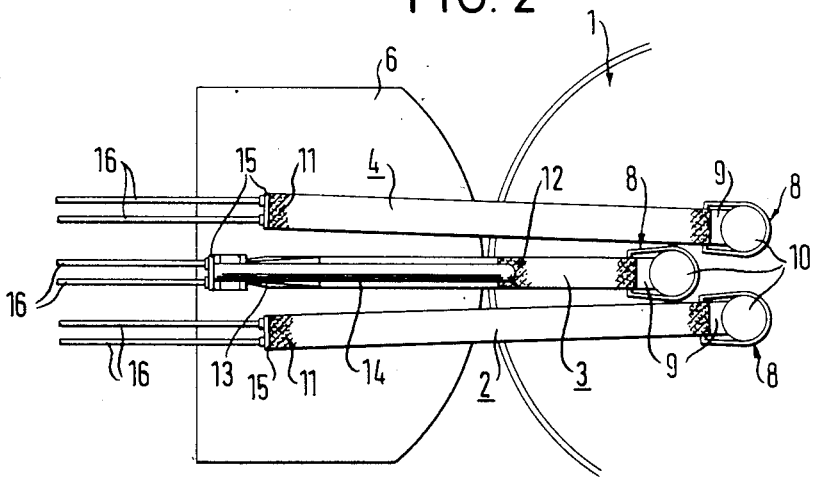

ELECTRIC ARC FURNACE

DESCRIPTION

The invention relates to an electric arc furnace comprising at least one electrode support arm which is provided with an electrode holding means including a contact jaw supported on the electrode support arm and connected to a heavy-current conductor, and also an electrode clamping stirrup displaceable by an actuating rod arranged within the electrode support arm and longitudinally displaceable by an actuating device. "The invention also relates to an electric arc furnace comprising a transformer, three electrode support arms which are disposed substantially in parallel relationship with each other in substantially one plane and which have on their outside at least over a portion of their length a layer of material which is a good conductor of electricity, for the supply of power to the respective electrode, and heavy-current conductors which electrically connect the transformer to the electrode support arms.".

In electric arc furnaces of that kind, the supply of power to the electrodes is by way of current cables and heavy-current tubes or solid bus bars which are fixed on the electrode support arm of the respective electrode.

In an electric arc furnace of the kind referred to above, the object of the present invention is to simplify the construction required for the feed of power. In relation to an electrode support arm which is formed by a box member or tubular member of steel, that is to say, a ferromagnetic material, the invention seeks to make it possible to render the heavy-current tubes or bus bars secured thereto redundant while nonetheless keeping magnetic losses at a low level. At the same time the invention aims to eliminate defect current paths and to provide that the electrode current is passed by way of a defined path to the contact jaw of the electrode. In addition, in an electric arc furnace having three electrode support arms which are disposed substantially in parallel relationship with each other, the invention seeks to provide that the symmetry of the three phases is substantially maintained, that is to say, the impedance of the current supply for the three electrodes is to be mutually matched. Using a simple arrangement, the invention seeks to avoid reactance asymmetry in respect of the current-carrying portions.

The structure achieving that object is characterised in that, at least over a part of its length, on the outside, the electrode support arm is provided with a layer of copper or other good conductor of electricity, and in that region forms the heavy-current conductor for the supply of power to the contact jaw, and the electrode clamping stirrup is electrically insulated from the electrode support arm. In an electric arc furnace having three electrode support arms which are disposed in substantially parallel relationship with each other in substantially one plane, in order to avoid reactance asymmetry the heavy-current conductor of at least one phase is formed with at least one loop.

In the electric arc furnace according to the invention, at least over a part of its length and on its outside, the electrode support arm is provided with a layer which is a good conductor of electricity, such as copper or aluminium. The region carrying the electrically conductive layer which is preferably applied by plating serves as a heavy-current conductor for the electrode current. As the layer which is a good conductor of electricy is electrically connected to the box or tube member of steel and an actuating device and an actuating rod for the electrode holding means is provided within the support arm, it is necessary for the electrode clamping stirrup to be electrically insulated with respect to the electrode support arm, in order to avoid defect current paths. In addition, for that purpose, the actuating rod is also to be insulated relative to the electrode support arm, at the end that is towards the electrode. In relation to an electric arc furnace comprising three electrode support arms which are disposed in substantially parallel relationship with each other, it is desirable for the current to be taken by way of a current tube over a part of the length of the support arm, and then to be taken on only from a middle region to the contact jaw by way of the electrode support arm, in order to increase the reactance of the middle support arm and to match it to the reactance of the two outer arms, that is to say, substantially to eliminate reactance asymmetry.

The loop which is provided in accordance with the invention is disposed between the transformer of the electric arc furnace and the respective electrode support arm, in particular the middle electrode support arm. By virtue of that arrangement, it is possible to eliminate the additional bus bar of the middle electrode support arm and the arrangement of that bus bar in relation to the other two electrode support arms, which is in the fashion of an equilateral triangle.

Embodiments of the invention are described in greater detail hereinafter by way of example with reference to the drawings in which:

FIGS. 1 and 2 are a partly sectional side view and a plan view showing the parts, which are important for understanding the invention, of an electric arc furnace comprising three electrode support arms which are disposed in substantially parallel relationship with each other;

Figure 3:
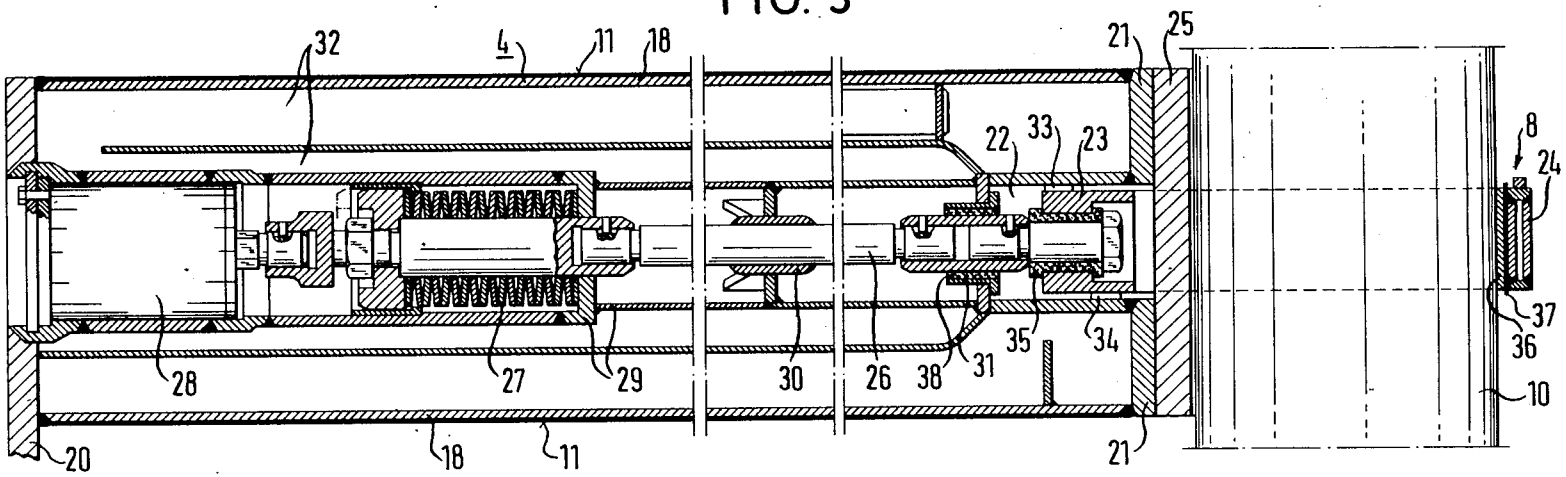
FIG. 3 is a view in longitudianl section of the construction of an electrode support arm.

FIGS. 1 and 2 show an electric arc furnace 1 comprising three electrode support arms 2, 3 and 4 which are disposed in substantially parallel relationship with each other, the sectional view of FIG. 1 illustrating only the electrode support arms 3 and 4. The electrode support arms can be raised and lowered in known fashion by means of lift columns 5 and can be pivoted to the side about an axis 7 by means of a portal structure 6 in which the lift columns 5 are guided. Each electrode support arm is provided with an electrode holding means 8 which includes a contact jaw 9 that bears against the electrode support arm; an electrode 10 is clamped in position on the electrode support arm and supplied with current by the electrode holding means 8. The electrodes 10 are in the form which is referred to as combination electrodes with a metallic upper portion and a lower portion which can be screwed on to the upper portion and which in operation burns away.

The two outer support arms 2 and 4 are provided over their entire length with a layer 11 which is a good conductor of electricity, comprising copper or aluminium, while the middle support arm 3 is provided with a layer 12 which is a good conductor of electricity, comprising copper or aluminium, only over a part of its length, from its end which is towards the electrode. The layers 11 and 12 are shown in FIGS. 1 and 2 by means of hatching only at the end of each of the respective layers 11 and 12. Fixed on the middle electrode support arm 3 by means of carrier arms 13 is a heavy-current tube 14 which is electrically connected to the electrode support arm 3 in the region thereof which is provided with the conductive layer 12. Connecting terminals 15 for heavy-current cables 16 are provided at the ends of the support arms 2 and 4 and the heavy-current tube 14, which are remote from the respective electrodes. The cables 16 are connected to a transformer (not shown) and supply the power for the electrodes 10. the electrode support arms 2 and 4 are each electrically insulated from the respectively associated lift column 5. The insulation is indicated in FIG. 1 by means of an insulating plate 17.

The support arms are of a box-like configuration and, besides cooling passages or ducts for a cooling fluid such as water, include a means for actuation of the electrode holding device. Details of the construction of the electrode support arm 4 and the holding means 8 will now be described with reference to FIGS. 3 and 4.

The electrode support arm 4 is formed by a box member comprising steel sheet 18 which is for example of 20 millimeter gauge and which at the outside of the arm is provided with a layer 11 which is a good conductor of electricity. In the case of the support arm 4 illustrated, the layer 11 is applied to the support arm therearound and over its entire length, while in the case of the electrode support arm 3, the layer is restricted to the region illustrated in FIG. 2, at the end that is towards the electrode. In a practical construction, a copper layer 11 which was 4 mm in thickness was plated on to a steel sheet 18 of 20 mm gauge. The copper plating is removed or omitted in the region of the mechanical junction to the lift column associated with the electrode support arm.

Figure 4:
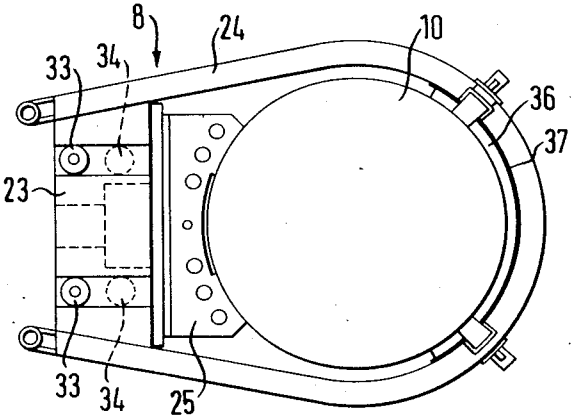
FIG. 4 shows a plan view of the electrode holding means.

In the view shown in FIG. 3, the box member forming the electrode support arm is closed off on the left-hand side by a connecting plate 20 and on the right-hand side by contact plates 21, each comprising a material which is a good conductor of electricity, preferably copper. The two contact plates 21 delimit a mounting space 22, which extends over the entire width of the support arm, for a holding portion 23 of a clamping stirrup 24 of the electrode holding means 8. As shown in FIG. 4, the holding portion 23 connects the ends of the electrode clamping stirrup 24 for clamping the electrode 10 in position. The electrode is clamped fast in position by the clamping stirrup 24 being pulled towards the left in the view shown in FIG. 3 by means of the holding portion 23, with the electrode being pressed against a contact portion 25 comprising a material which is a good conductor of electrocity, preferably copper, and which is fixed to the contact plates 21.

Displacement of the electrode clamping stirrup 24 towards the right results in the electrode holding device being released and the electrode 10 thus being freed. The displacement of the electrode clamping stirrup 24 is produced by an actuating rod 26 which is disposed centrally in the electrode support arm, by means of an actuating device comprising a spring pack 27 and a hydraulic cylinder unit 28 which, together with the actuating rod, are arranged within a central tube 29 of the electrode support arm. The spring pack 27 causes the actuating rod 26 to be drawn towards the left, in other words, the electrode holding means is held in the clamping position, while the hydraulic cylinder unit 28 urges the actuating rod towards the right against the spring force of the spring pack 27 and thus moves the electrode holding means into the release position. Disposed within the central tube 29 are guides 30 and 31 for the axialy displaceable actuating rod 26. Provided in the space between the central tube 29 and the steel sheet 18 are passages or ducts 32 for a cooling fluid for cooling the electrode support arm.

The electrode clamping stirrup 24 is electrically insulated with respect to the electrode support arm. For that purpose, as shown in FIG. 4, fitted into the top and the underside of the holding portion 23 are respective pairs of insulating sliding members 33 and 34 respectively, preferably comprising ceramic material; the members 33 and 34 project beyond the respective surface of the holding portion and bear against the top side and the bottom side respectively of the mounting space 22. The sliding members 33 and 34 are offset in the axial direction of the electrode support arm in order to be able to carry the moment applied to the clamping stirrup by the weight of the electrode. Besides that insulation, electrical insulation as indicated by reference numeral 35 is also provided between the holding portion 23 and the actuating rod 26, as well as insulation between the electrode clamping stirrup 24 and a clamping jaw 36 which bears against the electrode 10, being denoted by reference numeral 37. The electrode clamping stirrup 24 is therefore also electrically insulated with respect to the electrode 10. Finally, electrical insulation 38 is also provided between the actuating rod 26 and the guide 31 therefor, which is towards the electrode. That arrangement ensures that defect currents which can result in local overheating and damage cannot go by way of the electrode clamping stirrup and the actuating rod 26, within the electrode support arm and more particularly in the end region of the arm whichis towards the electrode. The current which is introduced by way of the connecting plate 20 is thus obliged to follow a defined path by way of the outside wall of the box member to the contact plates 21 and from there by way of the contact portion 25 into the electrode 10.

In the case of the middle electrode support arm 3, in order to compensate for the different reactances between the various support arms, the supply of current is initially by way of the current tube 14 and then, only from a middle region of the support arm 3, by a path similar to that described above with reference to the electrode support arm 4. The location at which the current is passed into the electrode support arm from the heavy-current tube 14 is determined on the basis of the requirement of matching the reactance of the middle electrode support arm to that of the two outer electrode support arms, in other words, eliminating reactance asymmetry. With a view to eliminating reactance asymmetry, the axis of the heavy-current tube 14 is displaced upwardly relative to the middle support arm to such a degree that, when the support arms 2, 3 and 4 are disposed in one plane, the axis of the tube 14, with the axes of the outer support arms, forms an equilateral triangle. It is assumed in relation to the described embodiment that the electric arc furnace is operated with a three-phase alternating current.

The layer which is a good conductor of electricity does not eed to extend over the entire periphery of the support arms. Good results were also achieved with a construction in which the two outer support arms only have a layer of plated copper on the top, the underside and the two inward sides that face towards each other. It will be appreciated that it is also possible to provide for local portions in which the plating is removed or omitted, provided that it is ensured that there is a sufficient cross-section to carry the current.

A simple arrangement by means of which reactance asymmetry can be avoided will be described hereinafter as a specific embodiment by way of example of the invention. This embodiment relates specifically to an electric arc furnace which is operated with three-phase alternating current and which has three electrodes, each having an associated electrode support arm. The three electrode support arms are disposed in parallel relationship to each other in one plane above the furnace vessel. For the purposes of feeding current to the individual electrodes, the electrode support arms are provided on their outside with a layer of a material which is a good conductor of electricity, for example copper, as was described in detail hereinbefore.

In order to avoid reactance losses, it is necessary for the impedance in the current paths of the three phases to be matched to each other. The loop (reactance loop) which is described in greater detail hereinafter is provided for that purpose. In the embodiment which is specifically described herein, a single loop is provided in that heavy-current conductor which is connected to the middle electrode support arm, being therefore connected to the electrode support arm indicated at 3 in FIG. 2.

Figure 6:
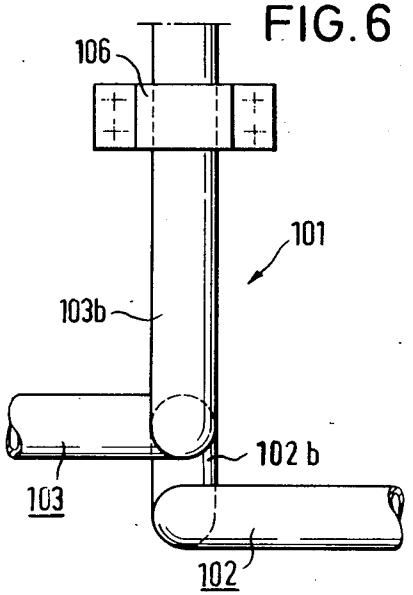
FIG. 6 is an elevational view of the loop shown in FIG. 5, viewing from the right.
Figure 5:
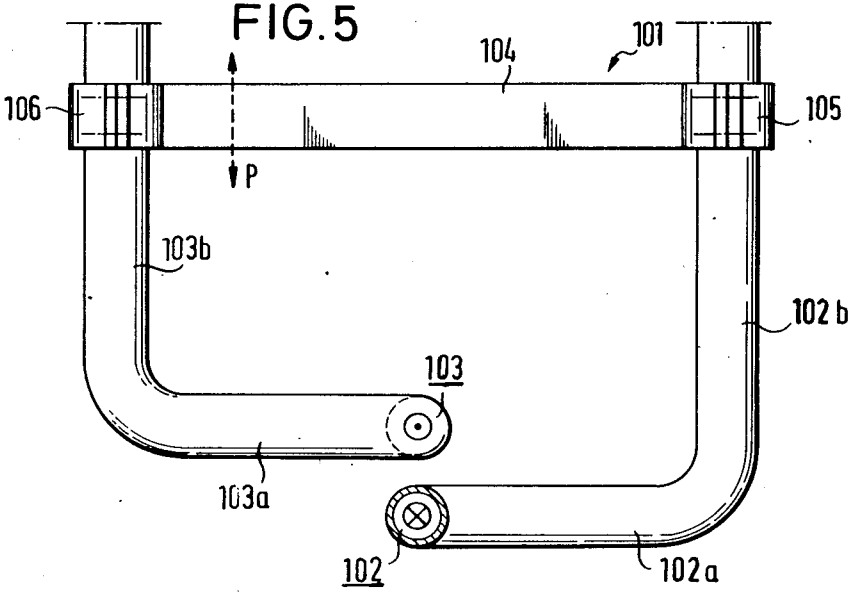
FIG. 5 is an elevational view of a reactance loop for the power supply to an electric arc furnace, the plane of the drawing being normal to the longitudinal axis of the heavy-current conductor sections between the transformer and the electrode support arm of the electric arc furnace.
Figure 7:
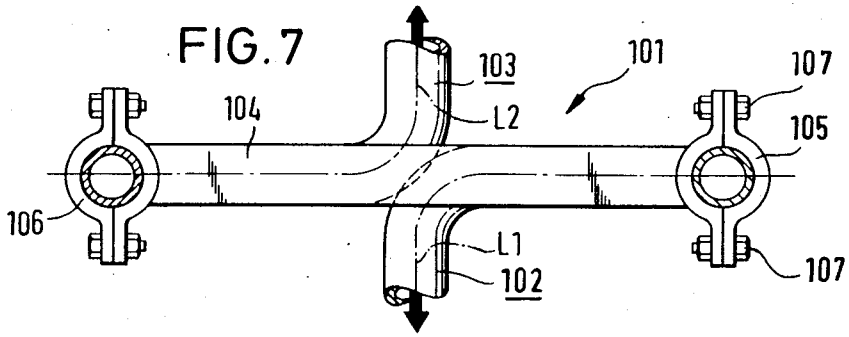
FIG. 7 is a view of the loop shown in FIG. 5, from above.
Figure 8:
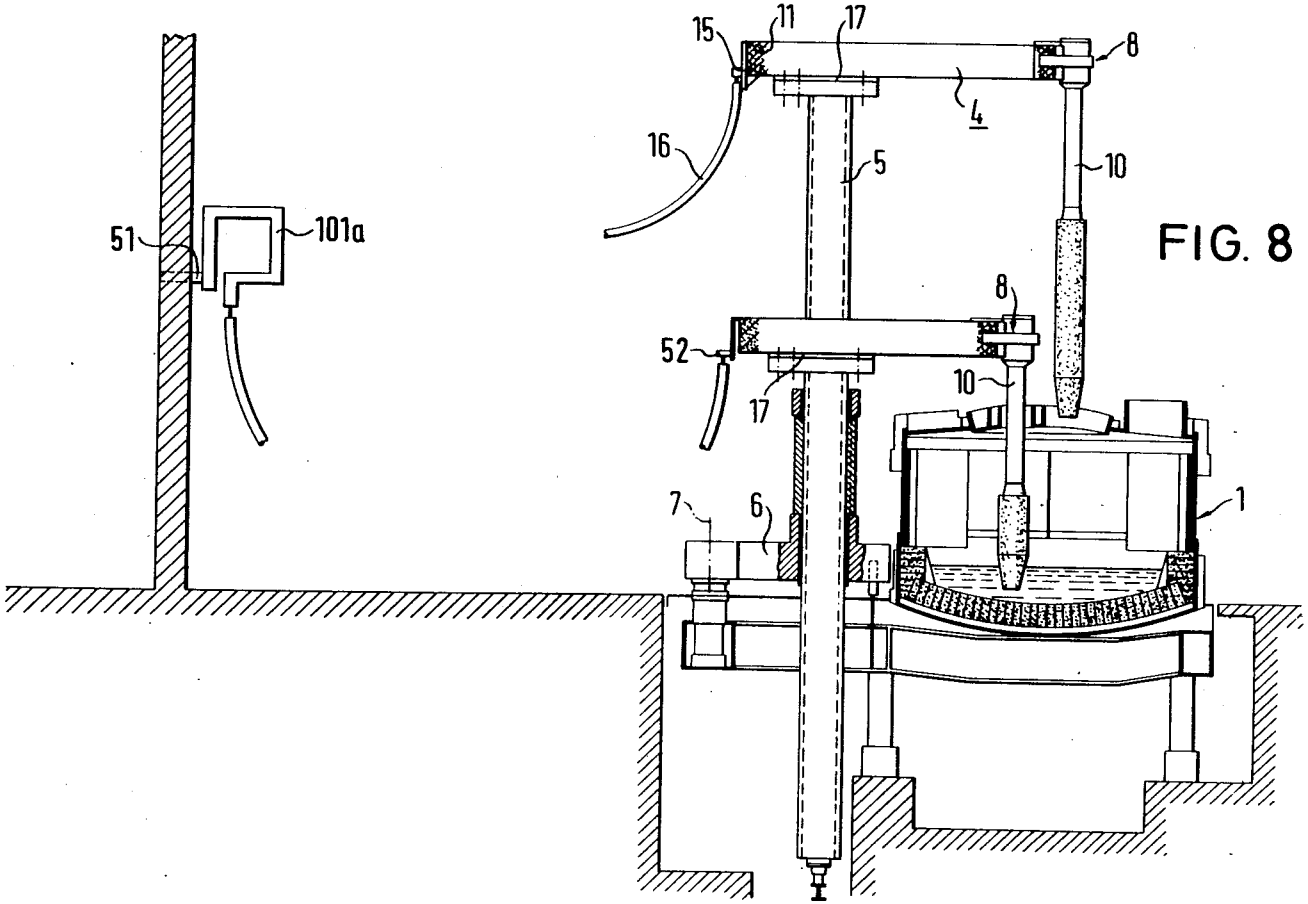
FIGS. 8 and 9 are side views similar to FIG. 1 showing connections of loops of the type of FIGS. 5 to 7 at the arc furnace.
Figure 9:
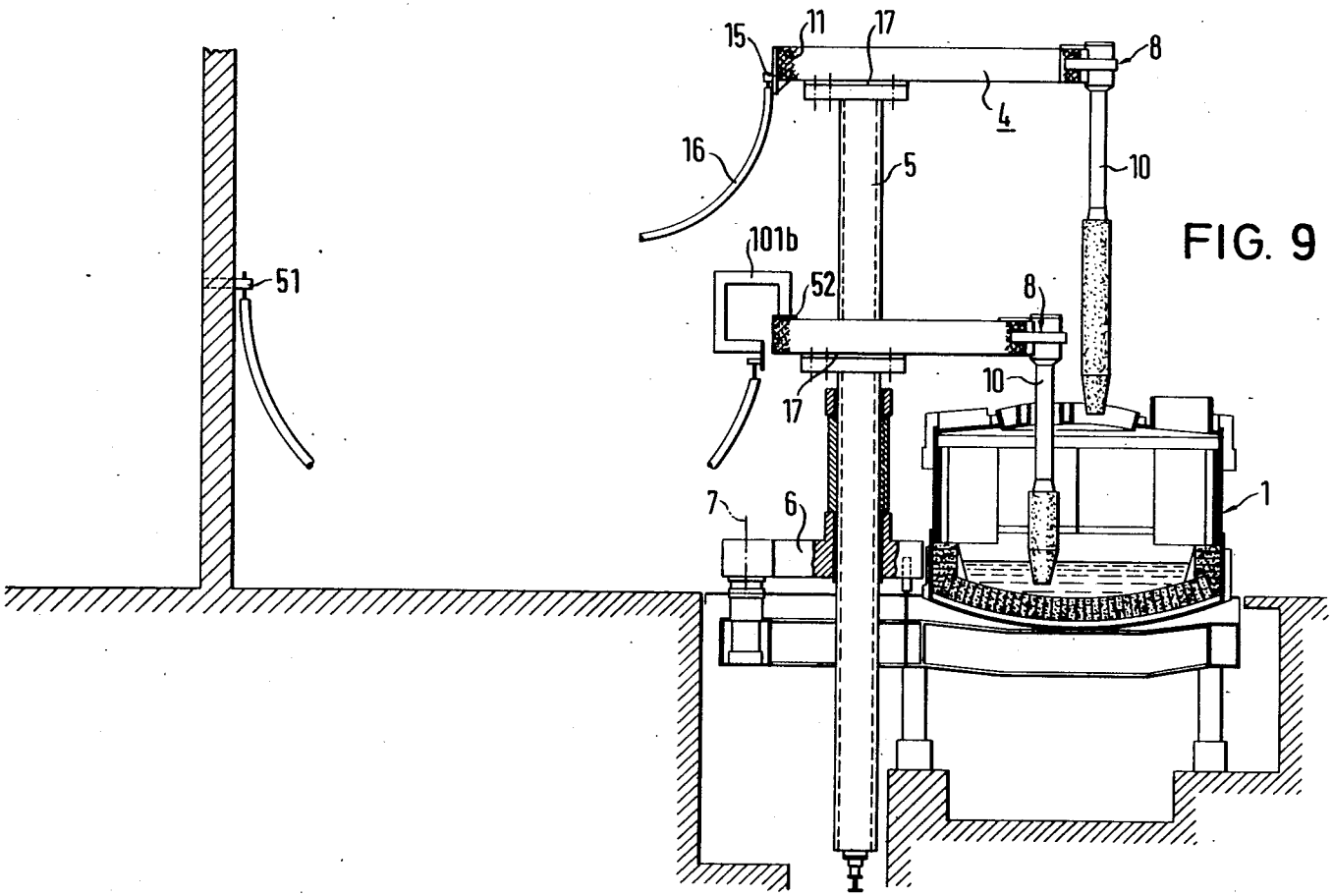

The loop 101 which is illustrated in FIGS. 5 through 7 is disposed for example at a location on the heavy-current cable associated with the middle electrode support arm 3, where the cable extends substantially horizontally.

At the location where the heavy-current cables which are denoted by reference numeral 16 in FIG. 2 extend substantially horizontally, the cables form two ends so that the cables are actually divided into two heavy-current conductor sections. A heavy-current conductor section 102 which is connected to the transformer has an end portion which is of such a configuration that it forms two straight sections 102a and 102b which extend at a right angle relative to each other and relative to the incoming heavy-current conductor section 102. A clamp connection 105 which comprises for example copper is fixed in the end region of the section 102b by means of screws 107. The clamp connection 105 is part of a transverse member 104 which also comprises for example copper or a material which is a similarly good conductor of electricity, while provided at the other end of the transverse member 104 is a clamp connection 106 which is similar to the clamp connection 105.

The screws 107 are shown in FIG. 7 and only indicated in FIGS. 5 and 6 by dash-dotted lines. The clamp connection 106 holds an end section 103*b* of a heavy-current conductor section 103 which leads to the furnace. Therefore, the sections 102 and 103 together form the heavy-current conductor cable 16 of which part is shown in FIG. 2. The heavy-current conductor section 103 is secured by its end remote from the loop 101, to the middle electrode support arm of the electric arc furnace. In the region of the loop, the heavy-current conductor section 103 is of such a configuration that it forms two end sections 103*a* and 103*b* which form a right angle relative to each other and with respect to the heavy-current conductor section 103.

As can be seen from FIG. 7, the loop 101 is disposed in a plane which extends normal to the centre lines L1 and L2 of the two heavy-current conductor sections 102 and 103. The direction of the current from the transformer to the furnace is indicated in FIG. 5.

In the present specific embodiment, the two heavy-current conductor sections 102 and 103 are individual cable sections, that is to say, the cable sections each have an open end, as can be seen from FIG. 5. As an alternative form of that construction, it is basically also possible to provide a continuous heavy-current cable, for example it is possible for the loop to be formed in the middle heavy-current conductor 16 shown in FIG. 2. In that case, in FIG. 5, the two free sectional areas of the ends of the cable would be joined together.

For the purposes of adjusting the reactance formed by the loop 101, in order to match the impedances in the three current feed means, the position of the transverse member 104 is varied with respect to the other parts of the loop. By releasing the screws 107, the transverse member 104 may be displaced upwardly and downwardly in the direction indicated by the arrow P in FIG. 5, whereby the periphery of the loop can be increased or reduced respectively.

In the case of the above-described specific embodiment, there is only a single reactance loop 101 in the heavy-current cable which is connected to the middle electrode support arm. In principle, one or more reactance loops may be provided for the purposes of achieving reactance symmetry, in each heavycurrent conductor between the transformer and the electrode support arm.

Like the heavy-current cable, the reactance loop is cooled with cooling water.

We claim:

1. An electric arc furnace comprising: at least one electrode support arm having electrode holding means including a contact jaw supported on the electrode support arm and connected to a heavy-current conductor, and also an electrode clamping stirrup displaceable by an actuating rod which is arranged within the electrode support arm and which is longitudinally displaceable by an actuating device between a clamping position in which the electrode clamping stirrup presses the electrode against the contact jaw and a release position in which the electrode clamping stirrup releases the electrode, at least over a part of its length, on the outside, the electrode support arm having a region which is provided with a layer of copper or another good conductor of electricity, and which forms the heavy-current conductor for the supply of power to the contact jaw, the electrode clamping stirrup being electrically insulated with respect to the electrode support arm, the actuating rod having an end portion which extends towards the electrode and is electrically insulatedly mounted in a sliding guide.

2. An electric arc furnace according to claim 1, wherein, in the region forming the heavy-current conductor, the electrode support arm has a cover of copper or another good conductor of electricity.

3. An electric arc furnace according to claim 1, wherein the electrode clamping stirrup is secured to a holding portion which is connected to the actuating rod and which is displaceable in the end portion.

4. An electric arc furnace according to claim 3, wherein the holding portion on a top and underside thereof has projecting insulating sliding members, the sliding members bearing against sliding surfaces on the support arm.

5. An electric arc furance according to claim 1, wherein the electrode clamping stirrup carries inside thereof a clamping jaw which is insulatedly set in position.

6. An electric arc furnace according to claim 1, comprising three electrode support arms which are disposed in substantially parallel relationship with each other, the two outer electrode support arms forming the heavy-current conductor over a larger part of their length than the middle electrode support arm, in the region acdjacent to the electrode.

7. An electric arc furnace according to claim 6, wherein the middle electrode support arm in the region which is remote from the electrode, carries a heavy-current tube or a bus bar, the heavy-current tube or the bus bar forming the heavy-current conductor in said region of the electrode support arm.

8. An electric arc furnace according to claim 1, wherein, in the region of the electrode support arm forming the heavy-current conductor, the layer extends over the entire periphery of the electrode support arm.

9. An electric arc furnace according to claim 8, wherein the layer on the electrode support arm is omitted in the region of the junction between the electrode support arm and an associated lift column.

10. An electric arc furnace according to claim 1, wherein the heavy-current conductor of at least one phase is formed with at least one loop.

11. An electric arc furnace according to claim 10, wherein the loop is disposed in a plane which extends normal to the center line of the heavy-current conductor upstream and downstream of the loop.

12. An electric arc furnace according to claim 10, wherein the loop is variable in size.

13. An electric arc furnace according to claim 12, wherein an end portion of a heavy-current conductor section connected to a transformer and an end portion of a heavy-current conductor section connected to the electrode support arm respectively form parts of the loop, the end portions being mechanically and electrically connected by a transverse member by releasable clamping connections.

14. An electric arc furnace comprising a transformer, three electrode support arms disposed substantially in parallel relationship with each other in substantially one plane and having on their outside at least over a portion of their length a layer of material which is a good conductor of electricity, for the supply of power to a respective electrode, and heavy-current conductors which electrically connect the transformer to the electrode support arms, the heavy-current conductor of at least one phase being formed with at least one loop.

15. An electric arc furnace according to claim 14, wherein the loop is disposed in a plane which extends normal to the center line of the heavy-current conductor portion upstream and downstream of the loop.

16. An electric arc furnace according to claim 14, wherein the loop is variable in size.

17. An electric arc furnace according to claim 16, wherein an end portion of a heavy-current conductor section connected to the transformer and an end portion of a heavy-current conductor section connected to the electrode support arm respectively form parts of the loop, the end portions being mechanically and electrically connected by way of a transverse member by releasable clamping connections.

* * * * *